US009478129B1

(12) United States Patent
Kothari et al.

(10) Patent No.: US 9,478,129 B1
(45) Date of Patent: Oct. 25, 2016

(54) VEHICLE MONITORING AND CONTROL SYSTEM

(71) Applicants: Vaibhavi Kothari, Sunnyvale, CA (US); Premal Ashar, Sunnyvale, CA (US)

(72) Inventors: Vaibhavi Kothari, Sunnyvale, CA (US); Premal Ashar, Sunnyvale, CA (US)

( * ) Notice: Subject to any disclaimer, the term of this patent is extended or adjusted under 35 U.S.C. 154(b) by 0 days.

(21) Appl. No.: 14/549,664

(22) Filed: Nov. 21, 2014

Related U.S. Application Data

(60) Provisional application No. 61/907,981, filed on Nov. 22, 2013.

(51) Int. Cl.
*G08G 1/07* (2006.01)
*G08G 1/01* (2006.01)
*G08G 1/087* (2006.01)

(52) U.S. Cl.
CPC ..... *G08G 1/0125* (2013.01); *G08G 1/087* (2013.01)

(58) Field of Classification Search
CPC ..... G08G 1/0125; G08G 1/087; G08G 1/096783; G01G 1/161; E01F 9/559; Y02B 60/50
USPC ..... 340/905, 906, 907, 933, 988, 901, 902, 340/937, 539.1, 539.25, 904; 701/301, 30, 701/303
See application file for complete search history.

(56) References Cited

U.S. PATENT DOCUMENTS

| | | | | |
|---|---|---|---|---|
| 6,699,577 | B2 * | 3/2004 | Nonoyama | B01D 53/8637 134/104.1 |
| 7,859,431 | B2 * | 12/2010 | Peddie | G08G 1/096783 340/907 |
| 8,045,760 | B2 * | 10/2011 | Stam | B60Q 1/1423 340/457.2 |
| 8,175,796 | B1 * | 5/2012 | Blackburn | G08G 1/161 340/902 |
| 2005/0104745 | A1 * | 5/2005 | Bachelder | F41G 9/00 340/906 |
| 2006/0125655 | A1 * | 6/2006 | McMahon | G08G 1/087 340/907 |
| 2008/0094249 | A1 * | 4/2008 | Pappas | G08G 1/087 340/906 |

* cited by examiner

*Primary Examiner* — Anh V La
(74) *Attorney, Agent, or Firm* — Brian R. Short

(57) ABSTRACT

Apparatuses, methods, apparatuses and systems for monitoring a one or more vehicles are disclosed. One system includes a plurality of road transceivers located along a vehicle roadway, wherein each road transceiver is operative to at least one of communicate with or sense the one or more vehicles as the one or more vehicles travels along the vehicle roadway. A controller interfaced with the plurality of road transceivers or a controller within at least one of the plurality of road transceivers is operative to determined one or more operative conditions of the one or more vehicles based on the communications with or the sensing of the one or more vehicles.

20 Claims, 9 Drawing Sheets

For an embodiment, each device includes:
- Low power trans-receiver radio
- P2P and Meshing
- GPS position
- Energy harvesting
- Backhauls to traffic management cloud infrastructure Vehicles
- Equipped with a low power trans-receiver radio
- Transmits Vehicle ID
- Receives lane, traffic and road hazard guidance For an embodiment, each device includes:

- Low power trans-receiver radio
- P2P and Meshing
- GPS position
- Energy harvesting
- Backhauls to traffic management cloud infrastructure Vehicles

- Equipped with a low power trans-receiver radio
- Transmits Vehicle ID
- Receives lane, traffic and road hazard guidance Electrochromatic Reflector – Each side can be of different color

VEHICLE MONITORING AND CONTROL SYSTEM

RELATED APPLICATION

This patent application claims priority to U.S. Provisional Patent Application Ser. No. 61/907,981 filed Nov. 22, 2013, which is herein incorporated by reference.

FIELD OF THE EMBODIMENTS

The described embodiments relate generally to vehicle monitoring. More particularly, the described embodiments relate to vehicle monitoring and controls.

BACKGROUND

Systems are being developed for providing automated control of automobiles or vehicles. These systems are very complex. These systems are typically camera-based, and all of the intelligence of the systems is located within the vehicles. The systems require very complex software for providing the automated control. Further, the systems are far from fail proof.

Additionally, the control of these systems is autonomous. That is, the systems only monitor and control each vehicle individually, and do not provide, for example, traffic monitoring of numbers of vehicles.

An optimal system further provides traffic monitoring, networking and communications with other vehicles and conditions surrounding the vehicle(s). Once the vehicles are networked, additional data management and control of vehicles is possible.

It is desirable to have a method, system and apparatus for monitoring and/or controlling vehicles that is simple to implement, but still able to provide intelligent control.

SUMMARY

One embodiment includes a system for monitoring a one or more vehicles. The system includes a plurality of road transceivers located along a vehicle roadway, wherein each road transceiver is operative to communicate with and/or sense the one or more vehicles. For an embodiment, each road transceiver is operative to at least one of communicate with or sense the one or more vehicles as the one or more vehicles travels along the vehicle roadway. For another embodiment, one or more of the road transceivers may communicate with the one or more vehicles regardless of whether the one or more vehicle is in motion. A controller interfaced with the plurality of road transceivers or a controller within at least one of the plurality of road transceivers is operative to determined one or more operative conditions of the one or more vehicles based on the communications with or the sensing of the one or more vehicles.

Another embodiment includes a system for monitoring a one or more vehicles. The system includes a plurality of road transceivers located along a vehicle roadway. Each road transceiver is operative to receive communications from or sense the one or more vehicles. For an embodiment, each road transceiver is operative to at least one of communicate with or sense the one or more vehicles as the one or more vehicles travels along the vehicle roadway. For another embodiment, one or more of the road transceivers communicates with the one or more vehicles regardless of whether the one or more vehicle is in motion. A controller interfaced with the plurality of road transceivers or a controller within at least one of the plurality of road transceivers is operative to obtain information related to the one or more vehicles based on the communications received from the one or more vehicles.

Another embodiment includes a road transceiver. The road transceiver includes a reflective surface, wherein the road transceiver is operable to be attached to a road surface and operable as a lane guide along the vehicle roadway, a sustainable power source for powering the road transceiver, a transceiver, and a controller. The controller is operative to receive communications from or sense the one or more vehicles as the one or more vehicles passes by the transceiver, and communicate with at least one of an external controller and/or another road transceiver.

Other aspects and advantages of the described embodiments will become apparent from the following detailed description, taken in conjunction with the accompanying drawings, illustrating by way of example the principles of the described embodiments.

DETAILED DESCRIPTION

Figure 1:
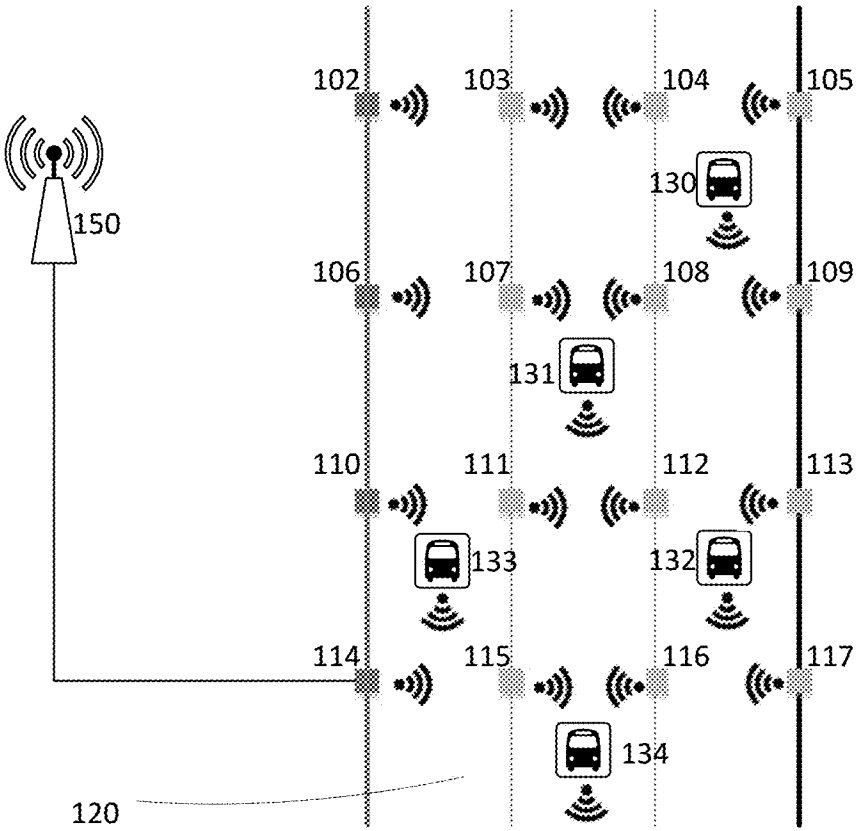
FIG. 1 shows vehicle monitoring and vehicle control system, according to an embodiment.

As shown in the drawings, the described embodiments are embodied in systems, methods and apparatuses for monitoring and/or controlling vehicles. The disclosed embodiments allow for intelligent sensing of location and conditions of one or more vehicles. Further, the disclosed embodiments provide for intelligent communication with and control of the one or more vehicles. For at least some embodiments, the communication and control is distributed and adaptive, and therefore, resistant to failure, and infinitely more intelligent than autonomous vehicle control. At least some embodiments are readily adapted for implementation into existing lane guides. For an embodiment, the transceivers that provide the functionality of the lane guides, are operable to form a mesh network, and further, could be self-powered. Therefore, the roadside transceivers of the described embodiments allow for a seamless conversion from traditional lane guides to the intelligent vehicle monitoring and control systems described.

FIG. 1 shows vehicle monitoring and vehicle control system, according to an embodiment. The system includes a plurality of road transceivers 102 . . . 117 located along a vehicle roadway 120. For an embodiment, the plurality of road transceivers 102 . . . 117 monitors one or more vehicles (such as, vehicles 130, 131, 132, 133) as the vehicles travel down the roadway 120.

Typically, roadways include lane guides that are small reflective apparatuses that are affixed along roadways to provide visual guidance to drivers of vehicles traveling along the roadways. At least some of the described embodiments include a conversion of these lane guides into transceivers that communicate with vehicles traveling along a roadway, or into intelligent sensors that sense vehicles traveling along the roadway.

For an embodiment, the road transceivers are operative to communicate with the one or more vehicles as the one or more vehicles travels along the vehicle roadway. That is, for an embodiment, a device on a vehicle (or the vehicle itself) includes at least a transmitter or a receiver, in which communication between the vehicle and at least one of the road transceivers occurs. As stated, as the vehicle travels along the roadway, communication is established between the device of the vehicle and the road transceiver. This communication allows the road transceivers to obtain information about a state or operational status of the vehicle.

Additionally or alternatively, for an embodiment, the road transceivers communicate the information to a controller that processes the information. Based on the processing, information can be fed back to the vehicles, or other roadway operation is influenced by the processed information. For example, the processed information can be used for providing full control of the vehicle. As such, the process information can provide control of the vehicle, thereby allowing the vehicle to not require an actual human driver. That is, the processing information feedback to the vehicle allows for driver-less operation of the vehicle. Additionally or alternatively, other roadway operation is influenced by the processed information, such as, lane guidance, traffic lights, and/or pedestrian lights, thereby providing a more efficient and safe way for controlling traffic.

Additionally or alternatively, for an embodiment, the transceivers act as beacons and supply external data to the vehicle or mobile application operating on a device on or within the vehicle to make decisions, thereby allowing the vehicle to not require an actual human being or provide additional assistance to humanly operated vehicle. Data communication from vehicle is to collect statistical data for traffic and big data analysis, which could be supplied back to other vehicles.

For an embodiment, the communication is initiated by the road transceiver. For an embodiment, the communication is initiated by the device of the vehicle or mobile application operating on a device of or within the vehicle. Either way, for an embodiment, the communication is enabled by wireless transmission between the device of the vehicle and the road transceiver. As the vehicle travels along the roadway, different road transceivers naturally become the one or more road transceivers that communicate with the device of the vehicle. That is, as the vehicle travels along the roadway, different road transceivers become within a wireless link range of the device of the vehicle due to the physical distance between the different road transceivers and the device of the vehicle.

For another embodiment, the road transceivers are operative to sense the one or more vehicles as the one or more vehicles travels along the vehicle roadway. That is, there may not be wireless electromagnetic communication between the vehicle and the road transceivers. For example, for an embodiment, the road transceivers include sensors that sense the passing of a vehicle. Based on the sensed information of many road transceivers, traffic management can be enhanced. Exemplary sensors include, but are not limited to passive infrared (PIR) sensors that provide vehicle infrared detection, kinetic sensors that sense vehicle road vibrations, photo sensors that include pixel analysis, or metal detection sensors.

For another embodiment, the road transceivers are operative to communicate with the one or more vehicle regardless of whether the vehicle is in motion or not. That is, for example, one or more of the vehicles may be parked, or stopped and not in motion. It is to be understood that the vehicle tracking and management of the described embodiments are not limited to vehicles in motion.

For an embodiment, a controller (such as, controller 150) is interfaced within one or more of the road transceivers. For an embodiment, the controller is a part of one or more of the road transceivers. For example, the road transceivers each include a separate controller, and the road transceivers form a wireless mesh network, wherein the processing of the wireless mesh network is distributed amongst the controllers of the road transceivers. For an embodiment, the controller is separate from the plurality of road transceivers. However, in either case, the controller is interfaced with one or more of the road transceivers, and operative to determined one or more operative conditions of the one or more vehicles based on the communications with or the sensing of the one or more vehicles.

Exemplary operative conditions of the vehicle include, but are not limited to steering of the vehicle, speed of vehicle, direction of vehicle, tracking locations of the vehicle, and/or performance and/or conditions of the mechanics (engine and/or other mechanical operation) of the vehicle.

As described, for an embodiment, the road transceivers sense the passing of the one or more vehicles and the vehicles travel down the roadway 120. For example, the one or more road transceivers can sense vibration or magnetically or photo or heat sense the vehicles passing by the one or more road transceivers. For an embodiment, the one or more road transceivers communicate with the vehicles when the vehicles pass by the one or more road transceivers. For an embodiment, the communication is wireless and is maintained while a particular vehicle while the particular vehicle is within a communication range provided by the wireless technology of the communication link. As stated, for an embodiment, the communication with the one or more vehicles includes the road transceiver receiving communication from the one or more vehicles. For an embodiment, the communication with the one or more vehicles includes the road transceiver receiving communication from the one or more vehicles, or communicating information to the one or more vehicles. Further, for an embodiment, the one or more vehicles respond to the information communicated from the road transceiver.

With an array or mesh of road transceivers 102 . . . 117 proximate to the roadway, the vehicles can be monitored as the vehicles travel along the roadway. Further, the road transceivers 102 . . . 117 can be linked to communication with each other forming a mesh network, or the road transceivers 102 . . . 117 can be linked to a central control 150 through, for example, a backhaul.

At least some embodiments provide monitoring and tracking of one or more vehicles by the array of road transceivers 102 . . . 117. Further, when connected to a controller, the controller 150 is provided with a wealth of information about the vehicles. Based on this information, analytics about the vehicles can be determined. Further, decisions can be made, and commands sent back to the vehicles through the road transceivers.

Exemplary information, analytics, and decisions include, but are not limited to traffic control, intelligent routing or mapping, identification of emergency situations, pedestrian safety, and/or management of emergency situations.

At least some embodiments include the road transceivers monitoring progress of the one or more vehicles as the one or more vehicles travel along the roadway. At least some embodiments monitor the one or more vehicles while the vehicles are stopped or parked.

At least some embodiments include the transceivers communicating with the one or more vehicles allowing at least some control of operation of the one or more vehicles as the one or more vehicles travel along the vehicle roadway. As such, automatic control of a vehicle can be inexpensively achieved. The expensive, complicated controls required by most self-driving vehicles can be greatly simplified. That is, the transceivers are able to obtain real-time information about the status of a vehicle. This real-time information can be used to control the vehicle.

The control of operation includes one or more of steering of the vehicle, controlling a speed of the vehicle, and controlling a direction of the vehicle. It is to be understood that this is not an exhaustive list, and the any imaginable control of a vehicle that is possible can be controlled by the described embodiments.

For at least some embodiments, the received communication includes a vehicle identifier of at least one of the one or more vehicles, thereby allow a monitoring of operating conditions specific to the at least one of the one or more vehicles, wherein the operating conditions include, for example, the speed of the vehicle, lane changes of the vehicle, driving performance of the vehicle—weaving, erratic behavior, etc., proximity with respect to other vehicles, and location of the vehicle at all times.

As previously described, for an embodiment, a plurality of road transceivers are operable to form a wireless mesh network, wherein a subset of the plurality of road transceiver are connected to one or more backhaul networks for networking the plurality of transceivers to one or more upstream servers. For at least some embodiments, the one or more upstream servers are operative to analyze traffic conditions and traffic flow. Such conditions include, for example, stalled vehicles, accidents, erratic behavior, over speeding of vehicles, locating a vehicle, and provide communication back to the one or more vehicles based on the analyzed traffic conditions, flow etc.

Once a link between a vehicle and the road transceivers has been established, many types of information can be communicated from the vehicle to a backend system. For example, information related to goods being carried by the vehicle can be monitored. For example, the temperature of a refrigeration truck can be monitored over the time of travel of the refrigeration truck, ensuring the products within the refrigeration truck are maintained at a proper temperature. Further, the length (time) of the travel of the vehicle can be monitored, thereby ensuring produce is maintained as fresh. The weight of a truck can be measured and monitored.

At least some embodiments of the vehicle monitoring and vehicle control system of FIG. 1, include transceivers include low-power transmit and receive (transceiver) radios. The multiple transceivers provide peer-to-peer communication, and allow for the formation of wireless mesh networks. For at least some embodiments, the transceivers include location technology, such as, GPS. At least some embodiments include the described energy harvesting technology (such as, solar) thereby allowing the transceivers to be self-operating and self-contained. For at least some embodiments, the transceiver are network connected through a backhaul to one or more upstream servers, thereby allowing for big data management of sensed or communicated information about vehicles or other persons or devices being monitored by the system.

For at least some embodiment, the one or more vehicles include an emergency vehicle, wherein the emergency vehicle is operable to control traffic light through the road transceivers. That is, for example, the road transceivers can sense an emergency vehicle. This information along with information obtained about other vehicles present allows for intelligent analysis of guidance of the emergency vehicle, and additionally, intelligent control of traffic signals. Further, for an embodiment, the traffic light control provides emergency vehicles and operators a mechanism to override certain controls like traffic lights to clear out traffic and make way for the emergency vehicles. For an embodiment, non-emergency traffic is cleared from the path of the emergency vehicle if the emergency vehicle is sensed, and an emergency condition is identified.

At least some embodiments include forming a mesh network between one or more of the road transceivers and the one or more vehicles. At least some embodiments include forming a mesh network between the one or more vehicles. At least some embodiments include forming a mesh network between one or more of the road transceivers and the one or more vehicles, wherein the mesh network provides distributed intelligence, is resilient, and provides control even when at least a portion of the road transceiver fails.

Figure 2:
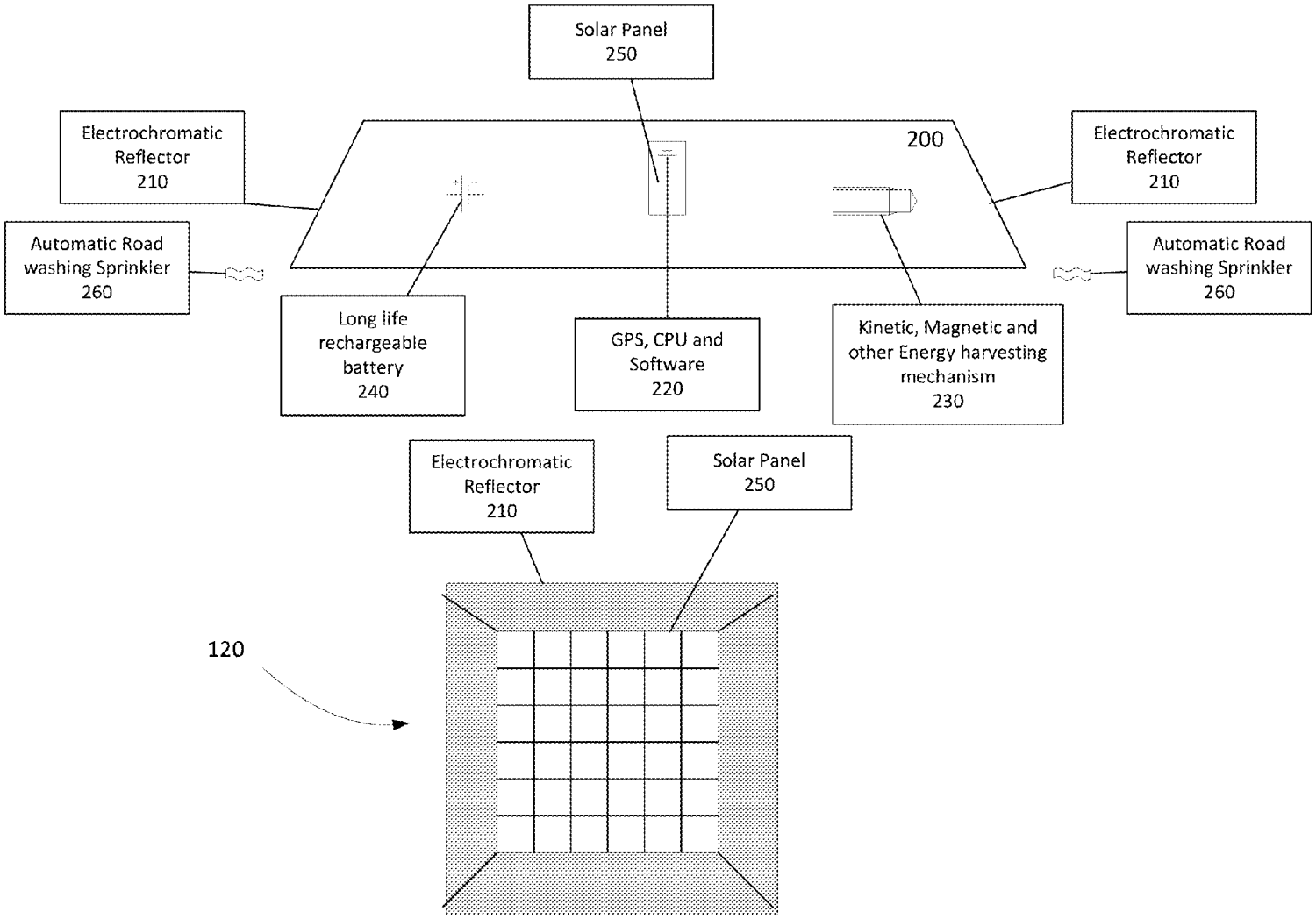
FIG. 2 shows a road transceiver of a vehicle monitoring and vehicle control system, according to an embodiment.

FIG. 2 shows a road transceiver 200 of a vehicle monitoring and vehicle control system, according to an embodiment. For an embodiment, the transceiver 200 includes a reflective surface 210. For an embodiment, the road transceiver 200 is operable to be attached to a road surface, sidewalks or proximate poles and operable as a lane guide along the vehicle roadway. In addition to operating a lane guide, the road transceiver includes electronics including, for example, a transceiver and a controller 220. For an embodiment, the controller 220 is operative to receive communications from or sense one or more vehicles as the one or more vehicles passes by the transceiver or are in communication range of the transceiver, and communicate with at least one of an external controller or another road transceiver. Further, to power the electronics, for an embodiment, the road transceiver includes a sustainable power source. Alternatively, or additionally, the road transceiver includes a battery of rechargeable power source 240.

For an embodiment, the sustainable power source comprises a kinetic energy source 230 that is operable to convert mechanical energy into electrical energy. For an embodiment, the vehicles in motion on a roadway generate vibrations, and the kinetic energy source converts the vibrations to electric energy.

For an embodiment, the sustainable power source comprises a solar (photo) energy source (solar panel 250) that is operable to convert solar energy into electrical energy. As previously stated, for at least some embodiments, the road transceiver 200 is attached to a roadway surface, and therefore, receives sunlight for large durations of time. Further, for an embodiment, during nighttime, headlight beams of vehicles and streetlights are received and used as an energy source.

For an embodiment, the road transceiver receives power from a low-power wired mesh network. That is, the road transceivers can be wired. However, the amount of power required by each road transceiver is small, and therefore, only a low-power wired mesh network is needed.

For an embodiment, the road transceiver receives power from a wireless or magnetic source. For an embodiment, wireless power modules are mounted with ordinary power source and power transferred wirelessly to transceivers in vicinity. Using principles of electrodynamics induction, power can be transferred between conductors or magnetic field interacting with moving metallic object (like vehicles) generating electric energy.

For at least some embodiments, the road transceiver includes an automatic road washing sprinkler 260. For an embodiment, the road transceivers are connected or include control processing. For an embodiment, the controlled processing intelligently determines when to activate the automatic road washing sprinklers 260 of multiple road transceivers. For example, the one of more controllers of the control processing can access a weather database and adaptively controller washing of the roadway based upon weather conditions and use of the roadway. Further, air quality can additionally influence the washing of the roadway. Further, use of the roadway can additionally influence the washing based on usage of the roadway. For at least some embodiments, water of some other cleaning fluid is provided to the road transceiver 200.

View 201 shows a top-view of at least one embodiment of the road transceiver 200, of which the surface of the road transceiver 200 includes an electromagnetic reflector 210 and a solar panel 250. For an embodiment, the electromagnetic reflector 210 can be modulated to reflect different colors of light. The varying colors of light can be used to communicate messages to users of the vehicles.

Figure 3:
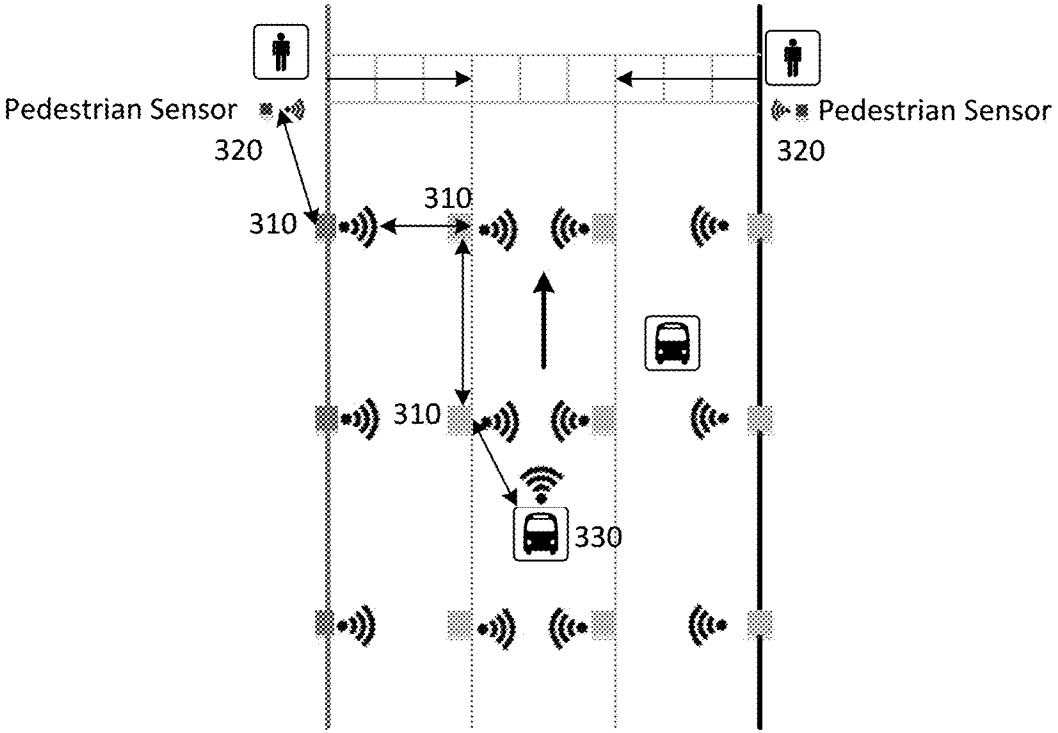
FIG. 3 shows vehicle monitoring and vehicle control system, according to another embodiment.

FIG. 3 shows vehicle monitoring and vehicle control system, according to another embodiment. This embodiment further includes a pedestrian sensor 320. The sensor can automatically sense the presence of a pedestrian. Further, based on the distributed communication provided, vehicles or others devices at other locations can be alerted to the presence of the pedestrian. Therefore, a vehicle can be alerted well before the vehicle encounters the pedestrian, thereby providing additional safety to the pedestrian. Further, compromised pedestrians, such as a handicap person, can be detected or sensed, and alerts and controls handled appropriately. It is to be understood that just about any condition can be sensed or detected. For example, debris in the road can be sensed, and operators of vehicle alerted accordingly, and traffic light controlled accordingly. For example, pedestrian sensor 320 can sense a pedestrian. The pedestrian sensor 320 can communicated through a series of transceivers (such as, transceivers 310) to a vehicle 330, thereby alerting the operator of the vehicle 330 of the presences of the pedestrian. Exemplary pedestrian sensors include, but are not limited to motion sensors, occupancy sensors, pressure sensors, or image (camera) sensors.

Figure 4:
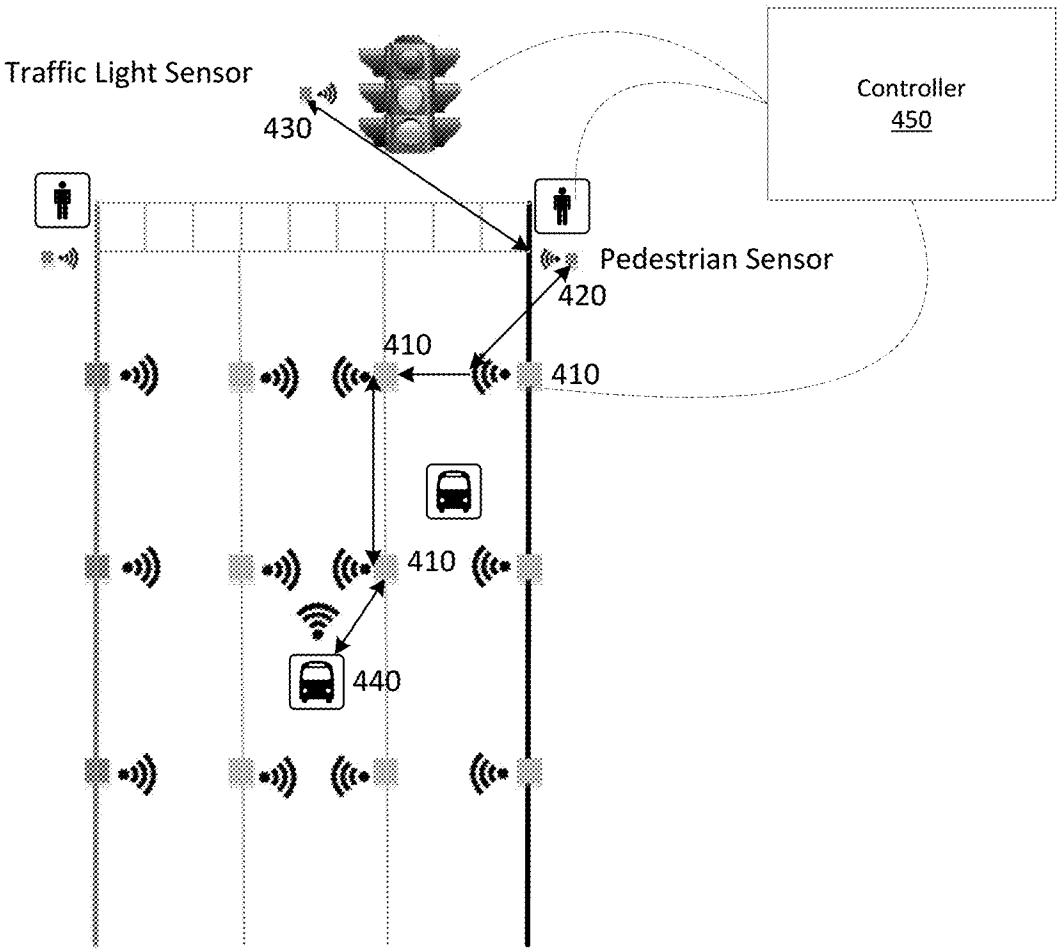
FIG. 4 shows vehicle monitoring and vehicle control system, according to another embodiment.

FIG. 4 shows vehicle monitoring and vehicle control system, according to another embodiment. This embodiment shows a pedestrian sensor 420 detecting a pedestrian, and alerting an operator of a vehicle 440 of the presence of the pedestrian through the transceivers 410, and further, provides traffic signal control and/or receives sensed signals from a traffic light 430.

For at least some embodiments, the road transceivers 410, the pedestrian sensor 420 and/or the traffic light 430 are all interfaced with a common or distributed controller 450. As such, analytics can be performed on signals sensed from each, which can then be used to intelligently control traffic (multiple vehicles), traffic flow, and/or pedestrian flow, and others who share the roadway (such as bicycles etc.) thereby providing efficiency in travel for all, and improved safety for all.

Figure 5:
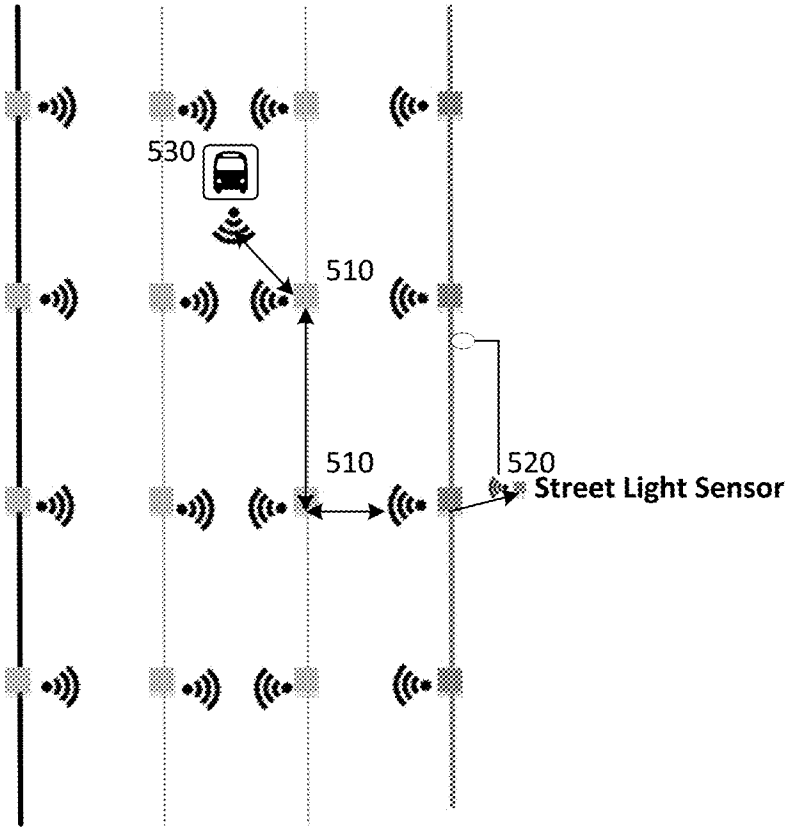
FIG. 5 shows vehicle monitoring and vehicle control system, according to another embodiment.

FIG. 5 shows vehicle monitoring and vehicle control system, according to another embodiment. This embodiment shows a street light sensor 520. Conditions can be sensed that indicate preferred control of a street light. Further, street lights can provide sensor input providing additional control. Operational performance of street lights can be monitored to improve maintenance of the lights. The amount of light emitted from the street light can be adjusted based upon sensed conditions.

As shown, a vehicle 530 traveling along the roadway interacts with road transceivers 510 as previously described. However, the street light sensor 510 provides additional sensing of the vehicle 530. For an embodiment, a transceiver mesh network formed by the road transceivers 510 are operative to generate an advance event for controlling street lights of an approaching vehicle so that roads are lit before the vehicle is in the area of the lite distribution.

Figure 6:
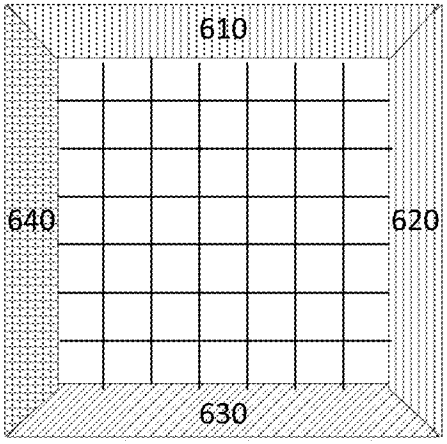
FIG. 6 shows a road transceiver of a vehicle monitoring and vehicle control system, according to an embodiment.

FIG. 6 shows a road transceiver of a vehicle monitoring and vehicle control system, according to an embodiment. For an embodiment, the viewable sides 610, 620, 630, 640 can be selected to have different colors to indicated conditions. For example, the road transceiver can depict a first color when viewed in one direction and a second color when viewed in a different direction. Further, the colors can be controllably changed by the controller of the road transceiver. For example, if an emergency condition is sensed, the color viewed by an observer can be controllably set to a bright red indicating the operator of a vehicle should stop immediately. Further, the observable color can adjustably be set to yellow to indicate caution due to an accident down the road or to indicate that ice may be present on the road. Further, the observable color can be used to indicate shared line direction with assistance from barriers.

For at least some embodiments, the color settings of the viewable sides 610, 620, 630, 640 of the road transceiver are controlled by embodiments of the vehicle monitoring and control systems as described. That is, the color settings of the viewable sides 610, 620, 630, 640 provide another means for the vehicle monitoring and control systems to control and manage traffic utilizing the unique sensing and communication techniques provided by the vehicle monitoring and control systems.

Figure 7:
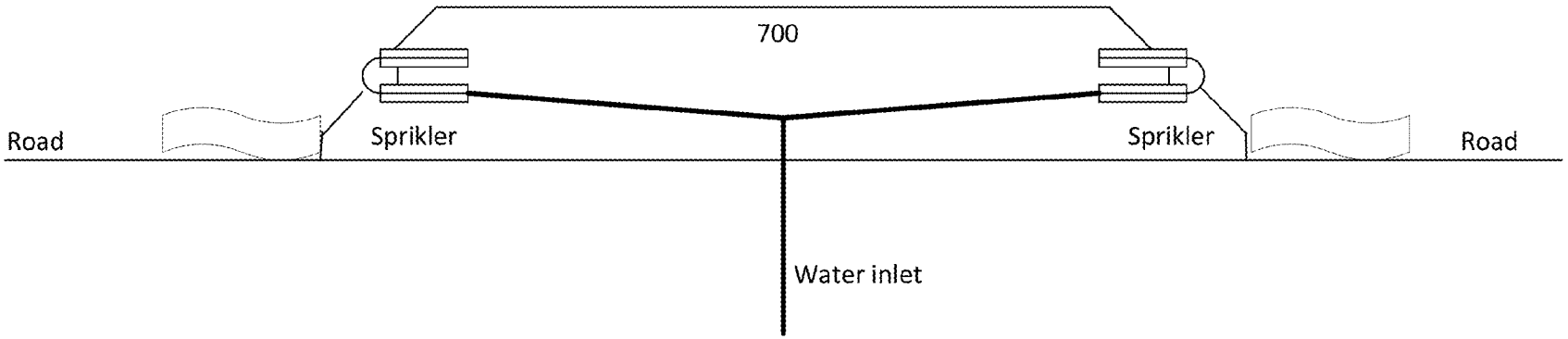
FIG. 7 shows a road transceiver of a vehicle monitoring and vehicle control system, according to an embodiment.

FIG. 7 shows a road transceiver 700 of a vehicle monitoring and vehicle control system, according to an embodiment. This embodiment further includes a sprinkler system for automatically washing the road. The backend intelligent provided by the described system can be used to intelligently control when the wash the road. Further, the road transceivers can include sensor that indicate when the road should be washed.

Figure 8:
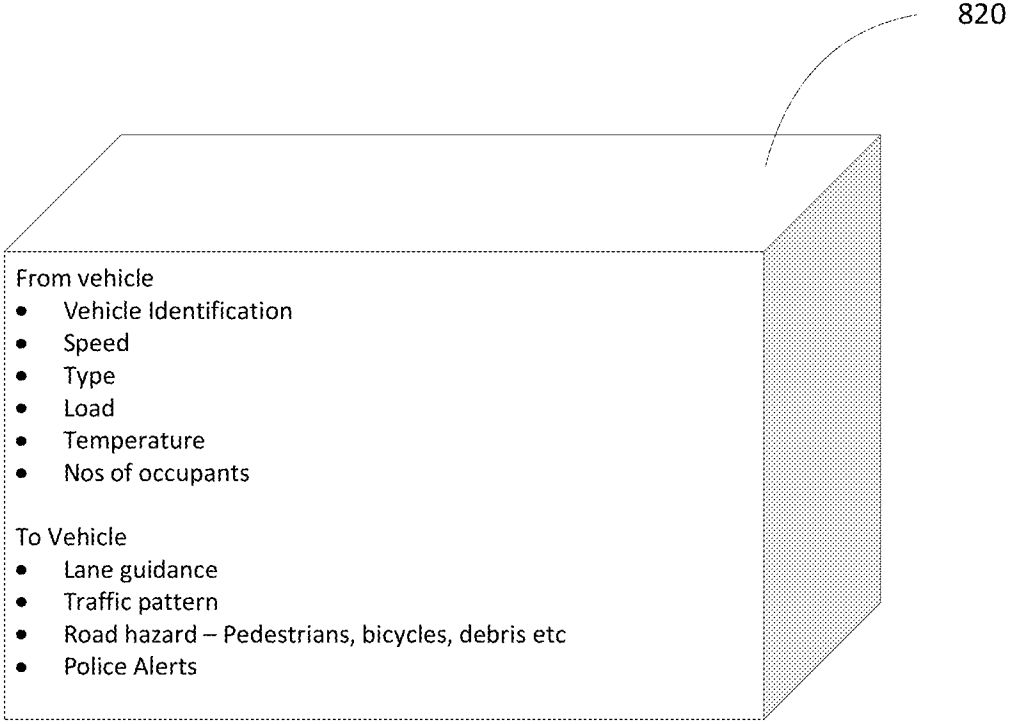
FIG. 8 shows a vehicle adapter for implementation of the vehicle monitoring and vehicle control system, according to an embodiment.

FIG. 8 shows a vehicle adapter for implementation of the vehicle monitoring and vehicle control system, according to an embodiment. This embodiment provide an vehicle adapter 820 that can be plugged into a vehicle to provide the vehicle with a data interface, communication systems and intelligence to allow the vehicle to operate with the vehicle monitoring and control systems described. For example, the adapter can facilitate communication from the vehicle a vehicle identification, the vehicle speed, a vehicle type, a vehicle load, a vehicle temperature, and/or a number of occupants within the vehicle. It is to be understood that this is not an exhaustive list.

While a vehicle adapter is show, it is to be understood that embodiments of the vehicle management and tracking systems include other embodiments, such as, an application running on either a device of the vehicle, or operating on a device within the vehicle. Either of these embodiments can include the pluggable device.

Further, for at least some embodiments, the vehicle adapter 820 further facilitates the reception of controls received from another controller. For at least some embodiment, such controls provide at least some control of the vehicle, the vehicle adapter 820 is interfaced with.

Further, for at least some embodiment, the adapter facilitates lane guidance, traffic patterns, road hazards and police alerts to the vehicle. It is to be understood that this is not an exhaustive list.

Figure 9:
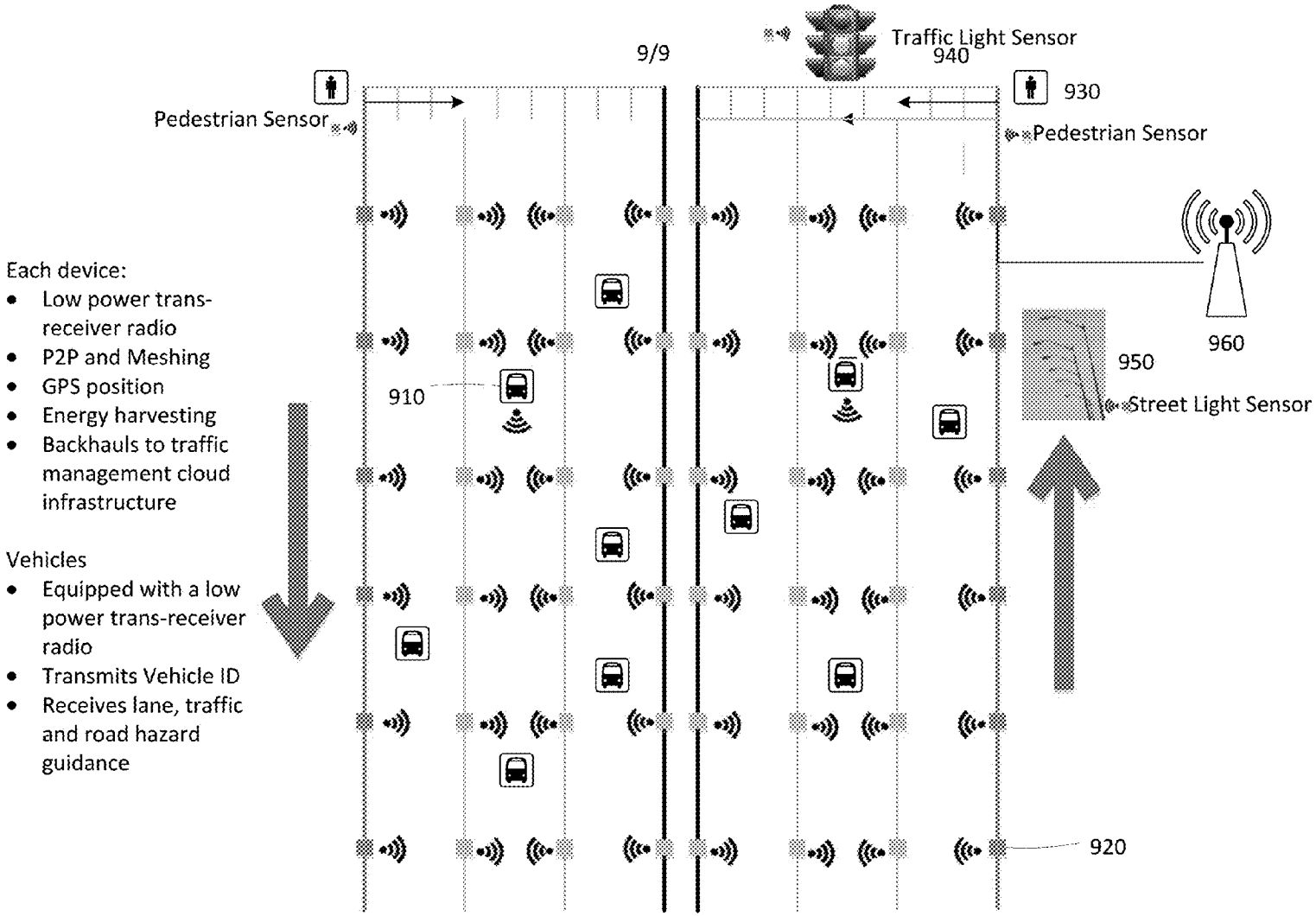
FIG. 9 shows vehicle monitoring and vehicle control system, according to another embodiment.

FIG. 9 shows vehicle monitoring and vehicle control system, according to another embodiment. This embodiment includes the road transceiver 920 being utilized along the perimeter, and within roadways in both directions. Further, transceivers are further integrated with street light sensors 950, traffic light sensors 940, and pedestrian sensors 930. For an embodiment, the transceivers form a wireless mesh network that provide distributed and resilient monitoring and controls of vehicles 910 located proximate to the roadways. For an embodiment, the road transceivers 920 are connected through a backhaul to an upstream server or controller 960.

FIG. 9 underscores that the various embodiments of the vehicle monitoring and vehicle control system can be combined to provide very intelligent vehicle monitoring control.

Although specific embodiments have been described and illustrated, the described embodiments are not to be limited to the specific forms or arrangements of parts so described and illustrated. The embodiments are limited only by the appended claims.

What is claimed is:

1. A system for monitoring a one or more vehicles, comprising:

an upstream server;

a plurality of road transceivers located along a vehicle roadway, wherein each road transceiver is connected through a network to the upstream server, and wherein each road transceiver is operative to:

at least one of communicate with or sense the one or more vehicles as the one or more vehicles travels along the vehicle roadway;

wherein each road transceiver is operable as a lane guide along the vehicle roadway;

wherein the upstream server is operative to:

determine one or more operative conditions of the one or more vehicles based on the communications with or the sensing of the one or more vehicles by the plurality of road transceivers;

monitor the one or more operating conditions of the one or more vehicles, wherein the operating conditions includes at least one of a speed of the one or more vehicles, lane changes of the one or more vehicles, driving performance of the one or more vehicles, proximity of the one or more vehicles with respect to other vehicles, location of the one or more vehicles over time;

communicate one or more controls of operation of the one or more vehicles to the one or more vehicles through the plurality of road transceivers based on the monitoring of the operating conditions;

wherein the communication of the one or more controls of operation include steering of the one or more vehicles, controlling a speed of the one or more vehicles, and controlling a direction of the of the one or more vehicles.

2. The system of claim 1, wherein the communication with the one or more vehicles comprises the road transceiver receiving communication from the one or more vehicles, or communicating information to the one or more vehicles.

3. The system of claim 2, further comprising the one or more vehicles responding to the information communicated from the road transceiver.

4. The system of claim 1, wherein at least one of the road transceivers comprises:

a wireless transceiver comprising a transmitter and a receiver;

a road transceiver controller, wherein the road transceiver controller is operative to:

receive communications from or sense the one or more vehicles as the one or more vehicles is within communication range of the wireless transceiver;

communicate with at least one of an external controller or another road transceiver.

5. The system of claim 4, wherein the road transceiver includes a reflective surface and is operable to be attached to a road surface.

6. The system of claim 4, wherein the road transceiver comprises a sustainable power source for powering the road transceiver.

7. The system of claim 6, wherein the sustainable power source comprises a kinetic energy source that is operable to convert mechanical energy into electrical energy.

8. The system of claim 6, wherein the road transceiver receives power from a wireless or magnetic source.

9. The system of claim 4, wherein the at least one of the road transceivers monitor progress of the one or more vehicles as the one or more vehicles travel along the roadway.

10. The system of claim 4, wherein the one or more road transceivers communicate with the one or more vehicles allowing at least some control of operation of the one or more vehicles as the one or more vehicles travel along the vehicle roadway, wherein the control of operation includes at least one of steering of the vehicle, speed of the vehicle, direction of the one or more vehicles.

11. The system of claim 4, wherein the at least one road transceiver comprises a plurality of road transceivers, wherein the plurality of road transceivers are operable to form a wireless mesh network, wherein a subset of the plurality of road transceiver are connected to one or more backhaul networks for networking the plurality of transceivers to the upstream server.

12. The system of claim 11, wherein the upstream server is operative to at least one of analyze traffic conditions or traffic flow, and provide communication back to the one or more vehicles based on the analyzed traffic conditions or traffic flow.

13. The system of claim 1, further comprising one or more sensors operative to detect a pedestrian or cyclist or animal or debris or any road sharers, and further, communicate presence of the pedestrian or animal or debris to the upstream server.

14. The system of claim 1, wherein the one or more vehicles includes an emergency vehicle, wherein the emergency vehicle is operable to control traffic lights through the road transceivers.

15. The system of claim 1, further comprising forming a mesh network between a plurality of the road transceivers and the one or more vehicles, wherein the mesh network provides distributed intelligence, and provides control even when at least a portion of the plurality of road transceivers fails.

16. The system of claim 1, wherein at least one of the plurality of road transceivers includes an electromagnetic reflector, and wherein the upstream server is operative to modulate the electromagnetic reflector to reflect different colors of light to communicate messages to users of the one or more vehicles.

17. A system for monitoring a one or more vehicles, comprising:

an upstream server;

a plurality of road transceivers located along a vehicle roadway, wherein each road transceiver is connected through a network to the upstream server, and wherein each road transceiver is operative to:

receive communications from or sense the one or more vehicles as the one or more vehicles travels along the vehicle roadway, and wherein each road transceiver includes a reflective surface and is operable as a lane guide along the vehicle roadway;

wherein the upstream server is operative to:

obtain information related to the one or more vehicles based on the communications received from the one or more vehicles;

monitor one or more operating conditions of the one or more vehicles from the obtained information, wherein the operating conditions includes at least one of a speed of the one or more vehicles, lane changes of the one or more vehicles, driving performance of the one or more vehicles, proximity of the one or more vehicles with respect to other vehicles, location of the one or more vehicles over time; and communicate one or more controls of operation of the one or more vehicles to the one or more vehicles through the plurality of road transceivers based on the monitoring of the operating conditions;

wherein the communication of the one or more controls of operation include steering of the one or more vehicles, controlling a speed of the one or more vehicles, and controlling a direction of the of the one or more vehicles.

18. The system of claim 17, wherein the information related to the one or more vehicles includes information related to freight carried by the one or more vehicles, present and past location of the vehicle, status indication of vehicle.

19. A road transceiver comprising:

a reflective surface, wherein the road transceiver is operable to be attached to a road surface and operable as a lane guide along the vehicle roadway, wherein the road transceiver includes one or more electromagnetic reflectors;

a sustainable power source for powering the road transceiver;

a transceiver;

a controller, wherein the controller is operative to:

receive communications from or sense the one or more vehicles as the one or more vehicles passes by the transceiver;

communicate with at least one of an external controller or another road transceiver; and modulate the one or more electromagnetic reflectors of the road transceiver to reflect different colors of light to communicate messages to users of the one or more vehicles.

20. The road transceiver of claim 19, further comprising an integrated sprinkler operative to clean a roadway.

* * * * *